US008088542B2

(12) United States Patent
Wu et al.

(10) Patent No.: US 8,088,542 B2
(45) Date of Patent: Jan. 3, 2012

(54) OVERCOAT CONTAINING TITANOCENE PHOTOCONDUCTORS

(75) Inventors: Jin Wu, Webster, NY (US); John F. Yanus, Webster, NY (US); Kenny-Tuan Dinh, Webster, NY (US); Kent J Evans, Lima, NY (US); Min-Hong Fu, Webster, NY (US); Susan M. Vandusen, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 944 days.

(21) Appl. No.: 12/059,669

(22) Filed: Mar. 31, 2008

(65) Prior Publication Data

US 2009/0246657 A1 Oct. 1, 2009

(51) Int. Cl.
*G03G 5/047* (2006.01)

(52) U.S. Cl. ..... 430/66; 430/58.65; 430/58.8; 430/59.1; 430/59.4; 430/59.6

(58) Field of Classification Search ..... 430/58.65, 430/58.8, 59.1, 59.4, 59.6, 66
See application file for complete search history.

(56) References Cited

U.S. PATENT DOCUMENTS

| | | | | |
|---|---|---|---|---|
| 4,265,990 | A | 5/1981 | Stolka et al. | |
| 4,298,697 | A | 11/1981 | Baczek et al. | |
| 4,315,980 | A * | 2/1982 | Sadamatsu et al. | 430/58.35 |
| 4,338,390 | A | 7/1982 | Lu | |
| 4,555,463 | A | 11/1985 | Hor et al. | |
| 4,560,635 | A | 12/1985 | Hoffend et al. | |
| 4,587,189 | A | 5/1986 | Hor et al. | |
| 5,473,064 | A | 12/1995 | Mayo et al. | |
| 5,482,811 | A | 1/1996 | Keoshkerian et al. | |
| 5,521,306 | A | 5/1996 | Burt et al. | |
| 6,913,863 | B2 | 7/2005 | Wu et al. | |
| 6,933,089 | B2 * | 8/2005 | Horgan et al. | 430/58.8 |
| 7,794,906 | B2 | 9/2010 | Wu | |
| 7,799,495 | B2 | 9/2010 | Wu et al. | |
| 7,811,732 | B2 | 10/2010 | Wu et al. | |
| 2006/0014093 | A1 * | 1/2006 | Li et al. | 430/66 |
| 2007/0031746 | A1 * | 2/2007 | Toshine et al. | 430/58.7 |
| 2007/0072101 | A1 * | 3/2007 | Dinh et al. | 430/66 |
| 2007/0196752 | A1 * | 8/2007 | Dinh et al. | 430/66 |
| 2007/0298342 | A1 * | 12/2007 | Wu et al. | 430/58.75 |
| 2009/0246658 | A1 | 10/2009 | Lin et al. | |
| 2009/0246659 | A1 | 10/2009 | Lin et al. | |
| 2009/0246660 | A1 | 10/2009 | Wu | |
| 2009/0246661 | A1 | 10/2009 | Wu et al. | |
| 2009/0246662 | A1 | 10/2009 | Wu et al. | |
| 2009/0246664 | A1 | 10/2009 | Wu | |
| 2009/0246666 | A1 | 10/2009 | Wu et al. | |

OTHER PUBLICATIONS

John F. Yanus et al., U.S. Appl. No. 11/593,657 on Overcoated Photoconductors with Thiophosphate Containing Charge Transport Layers, filed Nov. 7, 2006.

Jin Wu et al., U.S. Appl. No. 11/961,549 (Attorney Docket No. 20070482-US-NP) on Photoconductors Containing Ketal Overcoats, filed Dec. 20, 2007.

* cited by examiner

*Primary Examiner* — Mark F Huff
*Assistant Examiner* — Peter Vajda
(74) *Attorney, Agent, or Firm* — Oliff & Berridge, PLC

(57) ABSTRACT

A photoconductor that includes, for example, a supporting substrate, a photogenerating layer, a charge transport layer, and an overcoat layer that contains a titanocene.

26 Claims, No Drawings

OVERCOAT CONTAINING TITANOCENE PHOTOCONDUCTORS

CROSS REFERENCE TO RELATED APPLICATIONS

U.S. application Ser. No. 12/059,448, U.S. Publication No. 20090246658, filed Mar. 31, 2008 on Thiuram Tetrasulfide Containing Photogenerating Layer, the disclosure of which is totally incorporated herein by reference.

U.S. application Ser. No, 12/059,478, U.S. Publication No. 20090246659, now U.S. Pat. No. 7,935,466, filed Mar. 31, 2008, on Benzothiazole Containing Photogenerating Layer, the disclosure of which is totally incorporated herein by reference.

U.S. application Ser. No. 12/059,555, U.S. Publication No. 20090246662, filed Mar. 31, 2008 on Hydroxyquinoline Containing Photoconductors, the disclosure of which is totally incorporated herein by reference.

U.S. application Ser. No. 12/059,525, U.S. Publication No. 20090246660, filed Mar. 31, 2008 on Additive Containing Photoconductors, the disclosure of which is totally incorporated herein by reference.

U.S. application Ser. No. 12/059,536, now U.S. Pat. No. 7,794,906, filed Mar. 31, 2008 on Carbazole Hole Blocking Layer Photoconductors, the disclosure of which is totally incorporated herein by reference.

U.S. application Ser. No. 12/059,573, U.S. Publication No. 20090246664, filed Mar. 31, 2008 on Oxadiazole Containing Photoconductors, the disclosure of which is totally incorporated herein by reference.

U.S. application Ser. No. 12/059,587, now U.S. Pat. No. 7,811,732, filed Mar. 31, 2008 on Titanocene Containing Photoconductors, the disclosure of which is totally incorporated herein by reference.

U.S. application Ser. No. 12/059,663, U.S. Publication No. 20090246666, filed Mar. 31, 2008 on Thiadiazole Containing Photoconductors, the disclosure of which is totally incorporated herein by reference.

U.S. application Ser. No. 12/059,546, U.S. Publication No. 20090246661, filed Mar. 31, 2008 on Urea Resin Containing Photogenerating Layer Photoconductors, the disclosure of which is totally incorporated herein by reference.

U.S. application Ser. No. 12/059,689, now U.S. Pat. No. 7,799,495, filed Mar. 31, 2008 on Metal Oxide Overcoated Photoconductors, the disclosure of which is totally incorporated herein by reference.

In application Ser. No. 11/593,657, now U.S. Pat. No. 7,785,756, filed Nov. 7, 2006 on Overcoated Photoconductors With Thiophosphate Containing Charge Transport Layers, the disclosure of which is totally incorporated herein by reference, there is illustrated an imaging member comprising an optional supporting substrate, a photogenerating layer, and at least one charge transport layer, and wherein at least one charge transport layer contains at least one charge transport component and at least one thiophosphate; and an overcoat layer in contact with and contiguous to the charge transport layer, and which overcoat layer is comprised of an acrylated polyol, a polyalkylene glycol, a crosslinking component, and a charge transport component.

In U.S. application Ser. No. 11/961,549, now U.S Pat. No. 7,855,039 , filed Dec. 20, 2007 by Jin Wu et al. on Photoconductors Containing Ketal Overcoats, the disclosure of which is totally incorporated herein by reference, there is illustrated a photoconductor comprising a supporting substrate, a photogenerating layer, and at least one charge transport layer comprised of at least one charge transport component, and an overcoat layer and where the overcoat layer contains at least one of ketal. In embodiments the overcoat layer may include α-hydroxyketone, α-diketone, or mixtures thereof.

A number of the components and amounts thereof of the above copending applications, such as the supporting substrates, resin binders, photogenerating layer components, antioxidants, charge transport components, hole blocking layer components, adhesive layers, overcoat layer components, and the like, may be selected for the photoconductors of the present disclosure in embodiments thereof.

BACKGROUND

This disclosure is generally directed to members, photoreceptors, photoconductors, and the like. More specifically, the present disclosure is directed to rigid, and multilayered flexible, belt imaging members, or devices comprised of an optional supporting medium like a substrate, at least one of a photogenerating layer and a charge transport layer, including a plurality of charge transport layers, such as a first charge transport layer and a second charge transport layer, an optional adhesive layer, an optional hole blocking or undercoat layer, and an overcoat layer that contains a titanocene. At least one in embodiments refers, for example, to one, to from 1 to about 10, to from 2 to about 7; to from 2 to about 4, to two, and the like.

Yet more specifically, there is disclosed a photoconductor comprised of a supporting substrate, a photogenerating layer, a charge transport layer or charge transport layers, such as a first pass charge transport layer, and a second pass charge transport layer, and as a top layer in contact with the charge transport layer an overcoat layer that includes a titanocene, thereby permitting in embodiments abrasion resistance, crack resistance, wear resistance, minimal ghosting, acceptable light shock characteristics, excellent photoconductor photosensitivity and an acceptable, and in embodiments a low $V_r$; and minimization or prevention of $V_r$ cycle up.

Also disclosed are methods of imaging and printing with the photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, flexible belts disclosed herein can be selected for the Xerox Corporation iGEN3® machines that generate with some versions over 100 copies per minute. Processes of imaging, especially xerographic imaging and printing, including digital, and/or color printing, are thus encompassed by the present disclosure. The imaging members are in embodiments sensitive in the wavelength region of, for example, from about 400 to about 900 nanometers, and in particular from about 650 to about 850 nanometers, thus diode lasers can be selected as the light source. Moreover, the imaging members of this disclosure are useful in high resolution color xerographic applications, particularly high speed color copying and printing processes.

REFERENCES

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoresponsive imaging members have been described in numerous U.S. patents, such as U.S. Pat. No. 4,265,990, wherein there is illustrated an imaging member comprised of a photogenerating layer, and an aryl amine hole transport layer.

Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members of the present disclosure in embodiments thereof.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water; concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, where a pigment precursor Type I chlorogallium phthalocyanine is prepared by the reaction of gallium chloride in a solvent, such as N-methylpyrrolidone, present in an amount of from about 10 parts to about 100 parts, with 1,3-diiminoisoindolene ($DI^3$) in an amount of from about 1 part to about 10 parts, for each part of gallium chloride that is reacted; hydrolyzing the pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, for each weight part of pigment hydroxygallium phthalocyanine that is used, and, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components and processes of the above recited patents may be selected for the present disclosure in embodiments thereof.

SUMMARY

Disclosed in embodiments are imaging members with many of the advantages illustrated herein, such as extended lifetimes of service of, for example, in excess of about 1,000,000 imaging cycles; excellent electrical characteristics; stable electrical properties; low image ghosting; low background and/or minimal charge deficient spots (CDS); consistent $V_r$ (residual potential) that is with substantially no change over a number of imaging cycles as illustrated by the generation of known PIDC (Photoinduced Discharge Curve), extended wear resistance characteristics, light shock improvements, and the like. Also disclosed are layered photoresponsive imaging members which are responsive to near infrared radiation of from about 700 to about 900 nanometers.

Further disclosed are layered flexible photoconductive members with sensitivity to visible light.

Moreover, disclosed are rigid or drum and layered belt photoresponsive or photoconductive imaging members with mechanically robust charge transport layers.

Embodiments

Aspects of the present disclosure relate to a photoconductor comprising an optional supporting substrate, a photogenerating layer, at least one charge transport layer wherein at least one of the charge transport layers is comprised of at least one charge transport component; and an overcoat layer comprised of a crosslinked polymeric network, a titanocene, and a charge transport component; a photoconductor comprising in sequence a supporting substrate, a photogenerating layer, a charge transport layer, or layers, and thereover an overcoat layer comprised of an acrylated polyol, a polyalkylene glycol, a crosslinking component, a titanocene, and a charge transport compound, and wherein the titanocene is at least one of bis($\eta^5$-2,4-cyclopentadien-1-yl)bis[2,6-difluoro-3-(1H-pyrrol-1-yl)phenyl]titanium, titanocene bis(trifluoromethanesulfonate), titanocene dichloride, (indenyl)titanium (IV) trichloride, (pentamethylcyclopentadienyl)titanium (IV) trichloride, cyclopentadienyltitanium (IV) trichloride, bis(cyclopentadienyl)titanium (IV) pentasulfide, (4R,5R)-chloro-cyclopentadienyl-[2,2-dimethyl-1,3-dioxolan-4,5-bis(diphenylmethoxy)]titanium, and (4S,5S)-chloro-cyclopentadienyl-[2,2-dimethyl-1,3-dioxolan-4,5-bis(diphenylmethoxy)]titanium.

In embodiments, the titanocene is represented by the following formulas/structures, or mixtures thereof

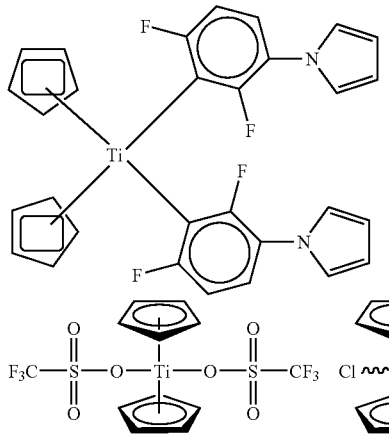

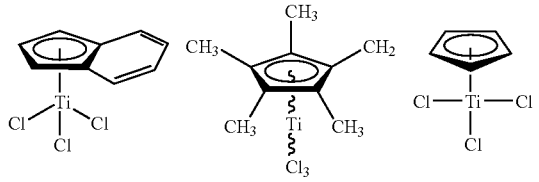

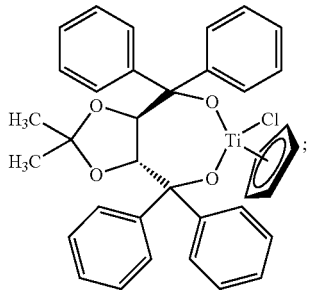

and a photoconductor comprised of a supporting substrate; a photogenerating layer comprised of at least one photogenerating pigment and an optional resin binder; a charge transport layer comprised of a hole transport compound and a resin binder; and in contact with and contiguous to the charge transport layer a protective layer comprised of a titanocene, a crosslinked polymer, and a hole transport compound.

Various effective amounts of the titanocenes, which in embodiments function primarily to enable light shock photoconductor improvement characteristics, can be added to or included in the overcoat layer, in an amount, for example, of from about 0.01 to about 30 weight percent, from about 0.05 to about 10 weight percent, from about 0.1 to about 3 weight percent, and wherein the photogenerating layer and at least one charge transport layer include a resin binder; wherein the at least one charge transport layer is from 2 to about 7, and the photogenerating layer is situated between the substrate and the at least one charge transport layer; a drum, or flexible imaging member comprising a supporting substrate, a hole blocking layer, an adhesive layer, a photogenerating layer, a charge transport layer, and an overcoat layer as illustrated herein; a photoconductive member with a photogenerating layer of a thickness of from about 0.1 to about 10 microns, at least one transport layer each of a thickness of from about 5 to about 100 microns; a xerographic imaging apparatus containing a charging component, a development component, a transfer component, and a fixing component, and wherein the apparatus contains a photoconductive imaging member comprised of a supporting substrate, and thereover a layer comprised of a photogenerating pigment and a charge transport layer or layers, and thereover an overcoat layer containing a titanocene, and where the transport layer is of a thickness of from about 10 to about 75 microns; a member wherein the titanocene or mixtures thereof is present in an amount of from about 0.1 to about 15 weight percent, or from about 0.3 to about 7 weight percent; a member wherein the photogenerating layer contains a photogenerating pigment present in an amount of from about 10 to about 95 weight percent; a member wherein the thickness of the photogenerating layer is from about 0.2 to about 4 microns; a member wherein the photogenerating layer contains an inactive polymer binder; a member wherein the binder is present in an amount of from about 20 to about 90 percent by weight, and wherein the total of all layer components is about 100 percent; a member wherein the photogenerating component is a hydroxygallium phthalocyanine, a chlorogallium phthalocyanine, a titanyl phthalocyanine, or a perylene that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate, goldized polyethylene terephthalate, titanized polyethylene terephthalate, titanized/zirconized polyethylene terephthalate, aluminized polyethylene naphthalate, goldized polyethylene naphthalate, titanized polyethylene naphthalate, or titanized/zirconized polyethylene naphthalate; an imaging member wherein the photogenerating resinous binder is selected from the group consisting of known suitable polymers like poly(vinyl chloride-co-vinyl acetate-co-maleic acid)s, polyesters, polyvinyl butyrals, polycarbonates, polystyrene-b-polyvinyl pyridine, and polyvinyl formals; an imaging member wherein the photogenerating pigment is a metal free phthalocyanine; a photoconductor wherein each of the charge transport layers, especially a first and second layer, comprises

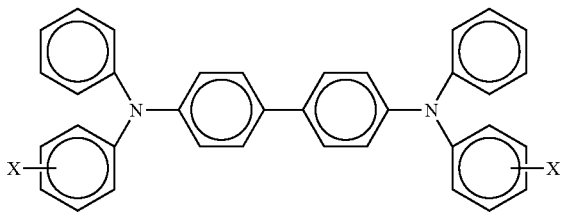

wherein X is selected from the group consisting of at least one of alkyl, alkoxy, and halogen such as methyl and chloride; and in embodiments where there is a total of four X substituents on each of the four terminating rings; an imaging member wherein alkyl and alkoxy contain from about 1 to about 15 carbon atoms; an imaging member wherein alkyl contains from about 1 to about 5 carbon atoms; an imaging member wherein alkyl is methyl; an imaging member wherein each of or at least one of the charge transport layers, especially a first and second charge transport layer, comprises

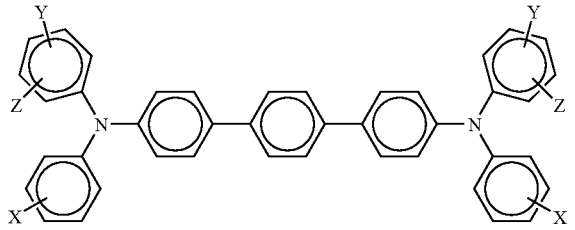

wherein X, Y and Z are independently selected from the group comprised of at least one of alkyl, alkoxy, aryl, and halogen, and in embodiments Z can be present, Y can be present, or both Y and Z are present; or wherein the charge transport component is

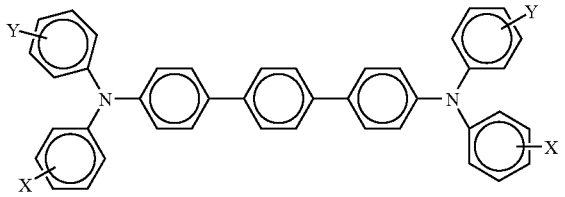

wherein X and Y are independently alkyl, alkoxy, aryl, a halogen, or mixtures thereof, an imaging member and wherein, for example, alkyl and alkoxy contains from about 1 to about 15 carbon atoms; alkyl contains from about 1 to about 5 carbon atoms; and wherein the resinous binder is selected from the group consisting of polycarbonates, polyarylates and polystyrene; an imaging member wherein the photogenerating pigment present in the photogenerating layer is comprised of chiorogallium phthalocyanine, titanyl phthalocyanine or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing the ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer using CuK alpha radiation (wavelength=0.1542 nanometer), at Bragg angles (2 theta +/−0.2°) 7.4, 9.8, 12.4, 16.2, 17.6, 18.4, 21.9, 23.9, 25.0, 28.1 degrees, and the highest peak at 7.4 degrees; a method of imaging wherein the imaging member is exposed to light of a wavelength of from about 400 to about 950 nanometers; a member wherein the photogenerating layer is situated between the substrate and the charge transport; a member wherein the charge transport layer is situated between the substrate and the photogenerating layer, and wherein the number of charge transport layers is 2; a member wherein the photogenerating layer is of a thickness of from about 0.1 to about 25 microns; a member wherein the photogenerating component amount is from about 0.05 weight percent to about 20 weight percent, and wherein the photogenerating pigment is dispersed in from about 10 weight percent to about 80 weight percent of a polymer binder; a member wherein the thickness of the photogenerating layer is from about 0.1 to about 11 microns; a member wherein the photogenerating and charge transport layer components are contained in a polymer binder; a member wherein the binder is present in an amount of from about 50 to about 90 percent by weight, and wherein the total of the layer components is about 100 percent; a photoconductor wherein the photogenerating resinous binder is selected from the group consisting of at least one of polyesters, polyvinyl butyrals, polycarbonates, polystyrene-b-polyvinyl pyridine, and polyvinyl formals; an imaging member wherein the photogenerating component is Type V hydroxygallium phthalocyanine, titanyl phthalocyanine, chiorogallium phthalocyanine, or mixtures thereof, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4'-diamine, N,N'-bis(4butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-dipheny-N,N'-bis(3-chlorophenyl)-[p-terphenyl]-4,4'-diamine molecules, and wherein the hole transport resinous binder is selected from the group consisting of polycarbonates and polystyrene; an imaging member wherein the photogenerating layer contains a metal free phthalocyanine; an imaging member wherein the photogenerating layer contains an alkoxygallium phthalocyanine; a photoconductive imaging member with a blocking layer contained as a coating on a substrate, and an adhesive layer coated on the blocking layer; an imaging member further containing an adhesive layer and a hole blocking layer; a color method of imaging which comprises generating an electrostatic latent image on the imaging member, developing the latent image, transferring, and fixing the developed electrostatic image to a suitable substrate; photoconductive imaging members comprised of a supporting substrate, a photogenerating layer, a hole transport layer and a top overcoating layer in contact with the hole transport layer, or in embodiments in contact with the photogenerating layer, and in embodiments wherein a plurality of charge transport layers are selected, such as for example, from 2 to about 10, and more specifically, 2 may be selected; and a photoconductive imaging member comprised of an optional supporting substrate, a photogenerating layer, and a first, second, and third charge transport layer.

TOP OVERCOAT LAYER EXAMPLES

In embodiments, the titanocenes present in the overcoat layer are comprised of at least one cyclopentadienyl (Cp) or substituted cyclopentadienyl anion bound to a titanium center in the oxidation state IV.

Examples of titanocenes, which are soluble or substantially soluble in a number of solvents, include bis($\eta^5$-2,4-cyclopentadien-1-yl)bis[2,6-difluoro-3-(1H-pyrrol-1-yl) phenyl]titanium, titanocene bis(trifluoromethanesulfonate), titanocene dichloride, (indenyl)titanium (IV) trichloride, (pentamethylcyclopentadienyl)titanium (IV) trichloride, cyclopentadienyltitanium (IV) trichloride, bis(cyclopentadienyl)titanium (IV) pentasulfide, (4R,5R)-chloro-cyclopentadienyl-[2,2-dimethyl-1,3-dioxolan-4,5-bis(diphenylmethoxy)]titanium, (4S,5S)-chloro-cyclopentadienyl-[2,2-dimethyl-1,3-dioxolan-4,5-bis(diphenylmethoxy)]titanium, and the like, and mixtures thereof. (R, S represents chirality of the center carbon, either left-handed or right-handed.)

Titanocenes that may be selected for the overcoat layer can be represented by at least one of the following

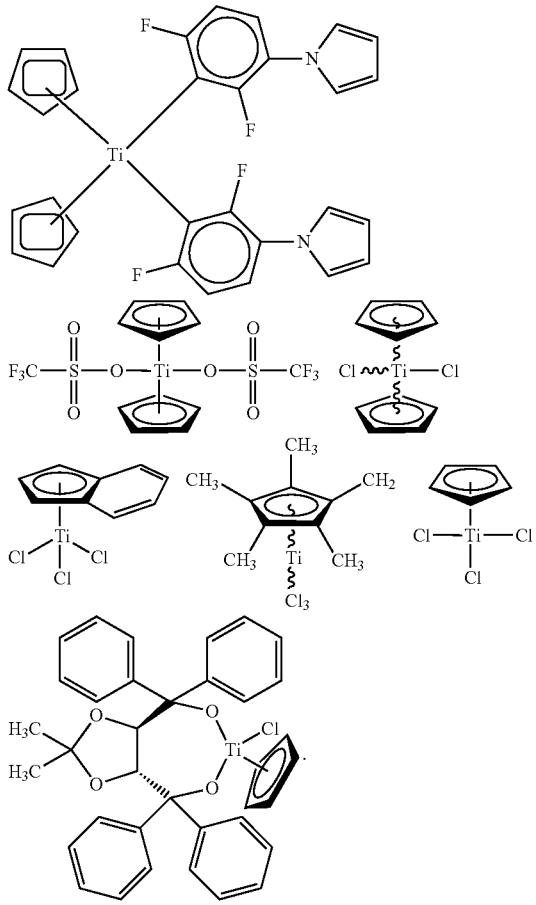

In addition to the titanocenes, the photoconductors disclosed herein include as part of the protective overcoat layer (POC) usually in contact with and contiguous to the charge transport layer, components that include (i) a polyol and/or acrylated polyol, and (ii) an alkylene glycol polymer, such as polypropylene glycol where the proportion of the acrylated polyol to the polypropylene glycol is, for example, from about 0.1:0.9 to about 0.9:0.1, at least one charge transport compound, and at least one crosslinking agent. The overcoat composition can comprise as a first polymer of a polyol and/or acrylated polyol with a hydroxyl number of from about 10 to about 20,000; a second polymer of an alkylene glycol with, for example, a weight average molecular weight of from about 100 to about 20,000, from about 400 to about 5,000, or from about 1,000 to about 2,000, a charge transport compound, an acid catalyst, and a crosslinking agent wherein the overcoat layer, which is crosslinked, contains polyols, such as a polyol and/or acrylated polyol and a glycol, a crosslinking agent residue, charge transport compound and a catalyst residue, all reacted into a polymeric network. While the percentage of crosslinking can be difficult to determine, and not being desired to be limited by theory, the overcoat layer is crosslinked to a suitable value, such as for example, from about 5 to about 50 percent, from about 5 to about 25 percent, from about 10 to about 20 percent, and in embodiments from about 40 to about 65 percent. Excellent photoconductor electrical response can also be achieved when the prepolymer hydroxyl groups, and the hydroxyl groups of the dihydroxy aryl amine (DHTBD) are stoichiometrically less than the available alkoxy, such as methoxy alkyl on the crosslinking, such as CYMEL® moieties.

The prepolymer contains a reactive group selected, for example, from the group consisting of hydroxyl and carboxylic acid. The term "prepolymer" refers, for example, to a monomer or low molecular weight polymer that contains reactive groups and forms a crosslinked polymer network when reacted with a crosslinking agent. Low molecular weight polymers result from reacting monomers to form very short polymers containing from about 5 to about 100 units. These products may exhibit poor mechanical properties. Increasing the chain length to from about 500 to about 1,000 units is helpful in achieving improved polymer properties. Crosslinked systems are somewhat dissimilar in that chain length cannot be readily determined due to their insolubility. Polymer chains are two dimensions, while crosslinking creates three dimensional networks. In embodiments, the prepolymer is a monomer or low molecular weight polymer containing hydroxyl or carboxylic acid.

The photoreceptor overcoat can be applied by a number of different processes inclusive of dispersing the overcoat composition in a solvent system, and applying the resulting overcoat coating solution onto a receiving surface, for example, the top charge transport layer of the photoreceptor to a thickness of, for example, from about 0.5 micron to about 15 microns, or from 1 micron to about 8 microns.

According to various embodiments, the crosslinkable polymer present in the overcoat layer can comprise a mixture of a polyol and an acrylated polyol film forming resin, and where, for example, the crosslinkable polymer can be electrically insulating, semiconductive or conductive, and can be charge transporting or free of charge transporting characteristics. Examples of polyols include a highly branched polyol where highly branched refers, for example, to a prepolymer synthesized using a sufficient amount of trifunctional alcohols, such as triols, or a polyfunctional polyol with a high hydroxyl number to form a polymer comprising a number of branches off of the main polymer chain. The polyol can possess a hydroxyl number of, for example, from about 10 to about 10,000, and can include ether groups, or can be free of ether groups. Suitable acrylated polyols can be, for example, generated from the reaction products of propylene oxide modified with ethylene oxide, glycols, triglycerol, and the like, and wherein the acrylated polyols can be represented by the following formula $$[R_t—CH_2]_t—[—CH_2—R_a—CH_2]_p—[—CO—R_b—CO—]_n—[—CH_2—R_c—CH_2]_p—[—CO—R_d—CO—]_q$$

wherein $R_t$ represents $CH_2CR_1CO_2$—, $R_1$ is alkyl with, for example, from 1 to about 25 carbon atoms, and more specifically, from 1 to about 12 carbon atoms, such as methyl, ethyl, propyl, butyl, hexyl, heptyl, and the like; $R_a$ and $R_c$ independently represent linear alkyl groups, alkoxy groups, branched alkyl, or branched alkoxy groups with alkyl and alkoxy groups possessing, for example, from 1 to about 20 carbon atoms; $R_b$ and $R_d$ independently represent alkyl or alkoxy groups having, for example, from 1 to about 20 carbon atoms; and m, n, p, and q represent mole fractions of from 0 to 1, such that n+m+p+q=1. Examples of commercial acrylated polyols are JONCRYL™ polymers, available from Johnson Polymers Inc., PARALOID™ polymers, available from Rohm and Haas, and POLYCHEM™ polymers, available from OPC polymers.

The overcoat layer further contains a charge transport component as illustrated herein, and more specifically, as represented by

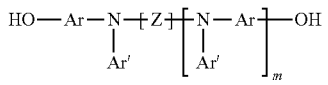

wherein m is zero or 1; Z is selected from the group consisting of at least one of

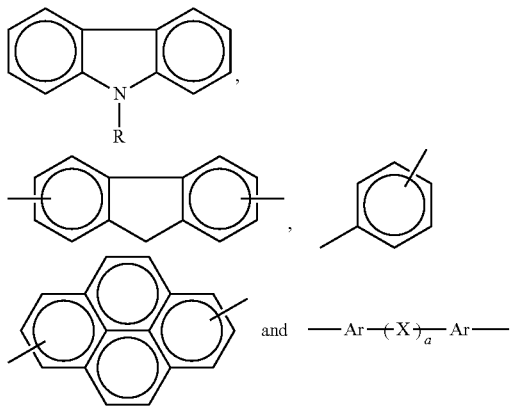

wherein n is 0 or 1; Ar is selected from the group consisting of at least one of

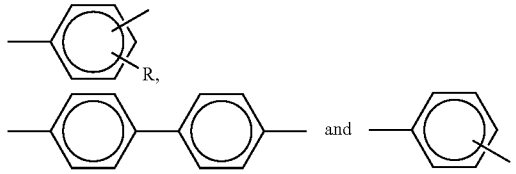

R is selected from the group consisting of at least one of —$CH_3$, —$C_2H_5$, —$C_3H_7$, and $C_4H_9$, and Ar' is selected from the group consisting of at least one of

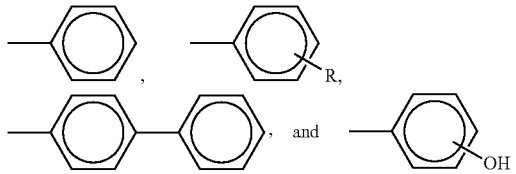

and X is selected from the group consisting of at least one of

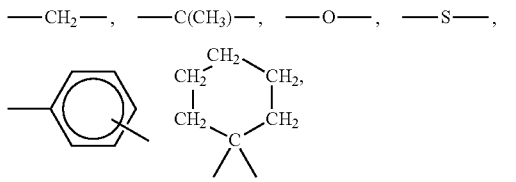

-continued

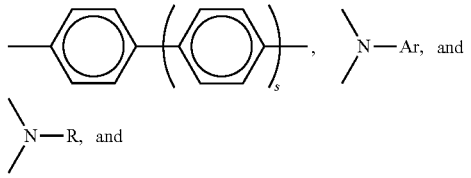

wherein S is zero, 1, or 2.

The overcoat layer includes, for example, in embodiments a crosslinking agent and catalyst where the crosslinking agent can be, for example, a melamine crosslinking agent or accelerator. Incorporation of a crosslinking agent can provide reaction sites to interact with the acrylated polyol to provide a branched, crosslinked structure. When so incorporated, any suitable crosslinking agent or accelerator can be used, including, for example, trioxane, melamine compounds, and mixtures thereof. When melamine compounds are selected, they can be functionalized, examples of which are melamine formaldehyde, methoxymethylated melamine compounds, such as glycouril-formaldehyde and benzoguanamine-formaldehyde, and the like. In some embodiments, the crosslinking agent can include a methylated, butylated melamine-formaldehyde. A nonlimiting example of a suitable methoxymethylated melamine compound can be CYMEL® 303 (available from Cytec Industries), which is a methoxymethylated melamine compound with the formula $(CH_3OCH_2)_6N_3C_3N_3$ and the following structure

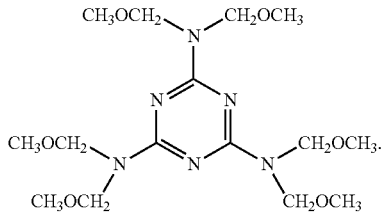

Additionally, there may optionally be included in the overcoat layer low surface energy components, such as hydroxyl terminated fluorinated additives, hydroxyl silicone modified polyacrylates, and mixtures thereof. Examples of the low surface energy components present in various effective amounts, such as from about 0.1 to about 25, from about 0.5 to about 15, from about 1 to about 10 weight percent, are hydroxyl derivatives of perfluoropolyoxyalkanes, such as FLUOROLINK® D (MW of about 1,000, and fluorine content of about 62 percent), FLUOROLINK® D10-H (MW of about 700, and fluorine content of about 61 percent), and FLUOROLINK® D10 (MW of about 500, and fluorine content of about 60 percent) (functional group —$CH_2OH$); FLUOROLINK® E (MW of about 1,000, and fluorine content of about 58 percent) and FLUOROLINK® E10 (MW of about 500, and fluorine content of about 56 percent) (functional group —$CH_2(OCH_2CH_2)_nOH$); FLUOROLINK® T (MW of about 550, and fluorine content of about 58 percent) and FLUOROLINK® T10 (MW of about 330, and fluorine content of about 55 percent) (functional group —$CH_2OCH_2CH(OH)CH_2OH$); and hydroxyl derivatives of perfluoroalkanes ($R_fCH_2CH_2OH$ wherein $R_f$=$F(CF_2CF_2)_n$) such as ZONYL® BA (MW of about 460, and fluorine content of about 71 percent), ZONYL® BA-L (MW of about 440, and fluorine content of about 70 percent), ZONYL® BA-LD (MW of about 420, and fluorine content of about 70 percent), and ZONYL® BA-N (MW of about 530, and fluorine content of about 71 percent); carboxylic acid derivatives of fluoropolyethers such as FLUOROLINK® C (MW of about 1,000, and fluorine content of about 61 percent), carboxylic ester derivatives of fluoropolyethers such as FLUOROLINK® L (MW of about 1,000, and fluorine content of about 60 percent), FLUOROLINK® L10 (MW of about 500, and fluorine content of about 58 percent), carboxylic ester derivatives of perfluoroalkanes ($R_fCH_2CH_2O(C{=}O)R$ wherein $R_f{=}F(CF_2CF_2)_n$ and R is alkyl) such as ZONYL® TA-N (fluoroalkyl acrylate, $R{=}CH_2{=}CH{-}$, MW of about 570, and fluorine content of about 64 percent), ZONYL® TM (fluoroalkyl methacrylate, $R{=}CH_2{=}C(CH_3){-}$, MW of about 530, and fluorine content of about 60 percent), ZONYL® FTS (fluoroalkyl stearate, $R{=}C_{17}H_{35}{-}$, MW of about 700, and fluorine content of about 47 percent), ZONYL® TBC (fluoroalkyl citrate, MW of about 1,560, and fluorine content of about 63 percent), sulfonic acid derivatives of perfluoroalkanes ($R_fCH_2CH_2SO_3H$ wherein $R_f{=}F(CF_2CF_2)_n$) such as ZONYL® TBS (MW of about 530, and fluorine content of about 62 percent); ethoxysilane derivatives of fluoropolyethers such as FLUOROLINK® S10 (MW of about 1,750 to 1,950); phosphate derivatives of fluoropolyethers such as FLUOROLINK® F10 (MW of about 2,400 to 3,100); hydroxyl derivatives of silicone modified polyacrylates such as BYK-SILCLEAN® 3700; polyether modified acryl polydimethylsiloxanes such as BYK-SILCLEAN® 3710; and polyether modified hydroxyl polydimethylsiloxanes such as BYK-SILCLEAN® 3720. FLUOROLINK® is a trademark of Ausimont, ZONYL® is a trademark of DuPont, and BYK-SILCLEAN® is a trademark of BYK.

Crosslinking can be accomplished by heating the overcoat components in the presence of a catalyst. Non-limiting examples of catalysts include oxalic acid, maleic acid, carbolic acid, ascorbic acid, malonic acid, succinic acid, tartaric acid, citric acid, p-toluenesulfonic acid (pTSA), methanesulfonic acid, dodecylbenzene sulfonic acid (DDBSA), dinonylnaphthalene disulfonic acid (DNNDSA), dinonylnaphthalene monosulfonic acid (DNNSA), and the like, and mixtures thereof. The catalyst is present in an amount of from about 0.1 to about 5, or from about 0.2 to about 3, or from about 0.5 to about 2 weight percent of the overcoat layer.

In embodiments, a blocking agent can also be included in the overcoat layer, which agent can "tie up" or substantially block the acid catalyst effect to provide solution stability until the acid catalyst function is desired. Thus, for example, the blocking agent can block the acid effect until the solution temperature is raised above a threshold temperature. For example, some blocking agents can be used to block the acid effect until the solution temperature is raised above about 100° C. At that time, the blocking agent dissociates from the acid and vaporizes. The unassociated acid is then free to catalyze the polymerization. Examples of such suitable blocking agents include, but are not limited to, pyridine, triethylamine, and the like as well as commercial acid solutions containing blocking agents such as CYCAT® 4045, available from Cytec Industries Inc.

The temperature used for crosslinking varies with the specific catalyst, the catalyst amount, heating time utilized, and the degree of crosslinking desired. Generally, the degree of crosslinking selected depends upon the desired flexibility of the final photoreceptor. For example, complete crosslinking, that is 100 percent, may be used for rigid drum or plate photoreceptors. However, partial crosslinking, for example from about 20 percent to about 80 percent, is usually selected for flexible photoreceptors having, for example, web or belt configurations. The amount of catalyst to achieve a desired degree of crosslinking will vary depending upon the specific coating solution materials, such as polyol/acrylated polyol, catalyst, temperature, and time used for the reaction. Specifically, the polyester polyol/acrylated polyol is crosslinked at a temperature between about 100° C. and about 150° C. A typical crosslinking temperature used for polyols/acrylated polyols with p-toluenesulfonic acid as a catalyst is less than about 140° C., for example 135° C., for about 1 minute to about 40 minutes. A typical concentration of acid catalyst is from about 0.01 to about 5 weight percent based on the weight of polyol/acrylated polyol. After crosslinking, the overcoating should be substantially insoluble in the solvent selected in which it was soluble prior to crosslinking, thus permitting substantially no overcoating material to be removed when rubbed with a cloth soaked in the solvent. Crosslinking results in the development of a three dimensional network which restrains the transport molecule in the crosslinked polymer network.

The overcoat layer can also include a charge transport material, as indicated herein, to, for example, improve the charge transport mobility of the overcoat layer. According to various embodiments, the charge transport material can be selected from the group consisting of at least one of (i) a phenolic substituted aromatic amine, (ii) a primary alcohol substituted aromatic amine, and (iii) mixtures thereof. In embodiments, the charge transport material can be a terphenyl of, for example, an alcohol soluble dihydroxy terphenyl diamine; an alcohol-soluble dihydroxy TPD, and the like. An example of a terphenyl charge transporting molecule can be represented by the following formula

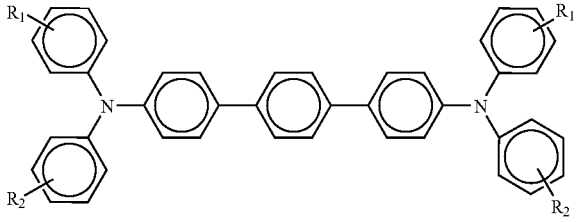

wherein each $R_1$ is —OH, and $R_2$ is alkyl ($—C_nH_{2n+1}$) where, for example, n is from 1 to about 10, from 1 to about 5, or from about 1 to about 6; and aralkyl and aryl groups with, for example, from about 6 to about 30, or about 6 to about 20 carbon atoms. Suitable examples of aralkyl groups include, for example, $—C_nH_{2n}$-phenyl groups where n is, for example, from about 1 to about 5 or from about 1 to about 10. Suitable examples of aryl groups include, for example, phenyl, naphthyl, biphenyl, and the like. In one embodiment, each $R_1$ is —OH to provide a dihydroxy terphenyl diamine hole transporting molecule. For example, where each $R_1$ is —OH and each $R_2$ is —H, the resultant compound is N,N'-diphenyl-N,N'-di[3-hydroxyphenyl]-terphenyl-diamine. In another embodiment, each $R_1$ is —OH, and each $R_2$ is independently an alkyl, aralkyl, or aryl group as defined above. In various embodiments, the charge transport material is soluble in the selected solvent used in forming the overcoat layer.

Any suitable secondary or tertiary alcohol solvent can be employed for the deposition of the film forming overcoat layer. Typical alcohol solvents include, but are not limited to, for example, tert-butanol, sec-butanol, n-butanol, 2-propanol, 1-methoxy-2-propanol, and the like, and mixtures thereof. Other suitable co-solvents that can be selected for the forming of the overcoat layer include, for example, tetrahydrofuran, monochlorobenzene, methylene chloride, toluene, xylene and mixtures thereof. These co-solvents can be used as diluents for the above alcohol solvents, or they can be omitted. However, in some embodiments, it may be of value to minimize or avoid the use of higher boiling alcohol solvents since they should be removed as they may interfere with efficient crosslinking.

In embodiments, the components, including the crosslinkable polymer, charge transport material, crosslinking agent, acid catalyst, and blocking agent, utilized for the overcoat solution should be soluble or substantially soluble in the solvents or solvents employed for the overcoat.

The thickness of the overcoat layer, which can depend upon the abrasiveness of the charging (for example bias charging roll), cleaning (for example blade or web), development (for example brush), transfer (for example bias transfer roll), in the system employed, is, for example, from about 1 or about 15 microns, from about 1 to about 3 microns, and from 1 to about 2 microns. In various embodiments, the thickness of the overcoat layer can be from about 1 micron to about 5 microns. Typical application techniques for applying the overcoat layer over the photoconductive layer can include spraying, dip coating, roll coating, wire wound rod coating, and the like. Drying of the deposited overcoat layer can be effected by any suitable conventional technique such as oven drying, infrared radiation drying, air drying, and the like. The dried overcoat layer of this disclosure should in embodiments transport charges during imaging, such as xerographic imaging.

In the dried overcoat layer, the composition can include from about 40 to about 90 percent by weight of film forming crosslinkable polymer, and from about 60 to about 10 percent by weight of a charge transport material. For example, in embodiments, the charge transport material can be incorporated into the overcoat layer in an amount of from about 20 to about 50 percent by weight. As desired, the overcoat layer can also include other materials, such as conductive fillers, abrasion resistant fillers, and the like, in any suitable and known amounts.

Although not desired to be limited by theory, the crosslinking agent can be located in the central region with the polymers like the acrylated polyol, polyalkylene glycol, and also charge transport component being associated with the crosslinking agent, and extending in embodiments from the central region.

PHOTOCONDUCTOR LAYER EXAMPLES

There can be selected for the photoconductors disclosed herein a number of known layers, such as substrates, photogenerating layers, charge transport layers, hole blocking layers, adhesive layers, protective overcoat layers, and the like. Examples, thicknesses, specific components of many of these layers include the following.

The thickness of the photoconductor substrate layer depends on many factors, including economical considerations, electrical characteristics, adequate flexibility, availability and cost of the specific components for each layer, and the like, thus this layer may be of substantial thickness, for example about 3,000 microns, such as from about 1,000 to about 2,000 microns, from about 500 to about 1,000 microns, or from about 300 to about 700 microns, ("about" throughout includes all values in between the values recited) or of a minimum thickness. In embodiments, the thickness of this layer is from about 75 microns to about 300 microns, or from about 100 to about 150 microns.

The photoconductor substrate may be opaque or substantially transparent and may comprise any suitable material having the required mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, this layer may be of substantial thickness of, for example, up to many centimeters or of a minimum thickness of less than a millimeter. Similarly, a flexible belt may be of a substantial thickness of, for example, about 250 micrometers, or of a minimum thickness of less than about 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, supporting substrate layers selected for the photoconductors of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo) perylene, titanyl phthalocyanines, and the like, and more specifically, vanadyl phthalocyanines, Type V hydroxygallium phthalocyanines, high sensitivity titanyl phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume. The maximum thickness of this layer in embodiments is dependent primarily upon factors, such as photosensitivity, electrical properties, and mechanical considerations.

The photogenerating composition or pigment can be present in a resinous binder composition in various amounts inclusive of up to 100 percent by weight. Generally, however, from about 5 percent by volume to about 95 percent by volume of the photogenerating pigment is dispersed in about 95 percent by volume to about 5 percent by volume of the resinous binder, or from about 20 percent by volume to about 30 percent by volume of the photogenerating pigment is dispersed in about 70 percent by volume to about 80 percent by volume of the resinous binder composition. In one embodiment, about 90 percent by volume of the photogenerating pigment is dispersed in about 10 percent by volume of the resinous binder composition, and which resin may be selected from a number of known polymers, such as poly (vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like, hydrogenated amorphous silicon and compounds of silicon and germanium, carbon, oxygen, nitrogen, and the like fabricated by vacuum evaporation or deposition. The photogenerating layers may also comprise inorganic pigments of crystalline selenium and its alloys; Groups II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder and fabricated by solvent coating techniques.

Examples of binders are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly (phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene, and acrylonitrile copolymers, poly(vinyl chloride), vinyl chloride and vinyl acetate copolymers, acrylate copolymers, alkyd resins, cellulosic film formers, poly(amideimide), styrenebutadiene copolymers, vinylidene chloride-vinyl chloride copolymers, vinyl acetate-vinylidene chloride copolymers, styrene-alkyd resins, poly(vinyl carbazole), and the like. These polymers may be block, random, or alternating copolymers.

Various suitable and conventional known processes may be used to mix, and thereafter apply the photogenerating layer coating mixture, like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 30, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking or hole blocking layer or interfacial layer and the photogenerating layer. Usually, the photogenerating layer is applied onto the blocking layer and a charge transport layer or plurality of charge transport layers are formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As an optional adhesive layer usually in contact with or situated between the hole blocking layer and the photogenerating layer, there can be selected various known substances inclusive of copolyesters, polyamides, poly(vinyl butyral), poly(vinyl alcohol), polyurethane, and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The optional hole blocking or undercoat layer for the imaging members of the present disclosure can contain a number of components including known hole blocking components, such as amino silanes, doped metal oxides, a metal oxide like titanium, chromium, zinc, tin and the like; a mixture of phenolic compounds and a phenolic resin or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol);

hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent and, more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The optional hole blocking layer may be applied to the substrate. Any suitable and conventional blocking layer capable of forming an electronic barrier to holes between the adjacent photoconductive layer (or electrophotographic imaging layer) and the underlying conductive surface of substrate may be selected.

A number of charge transport compounds can be included in the charge transport layer, which layer generally is of a thickness of from about 5 microns to about 75 microns, and more specifically, of a thickness of from about 10 microns to about 40 microns. Examples of charge transport components are aryl amines of the following formulas/structures

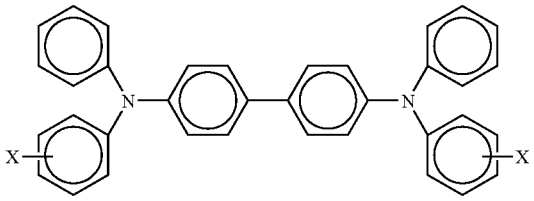

and

-continued

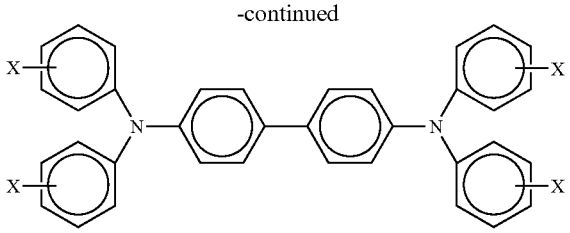

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

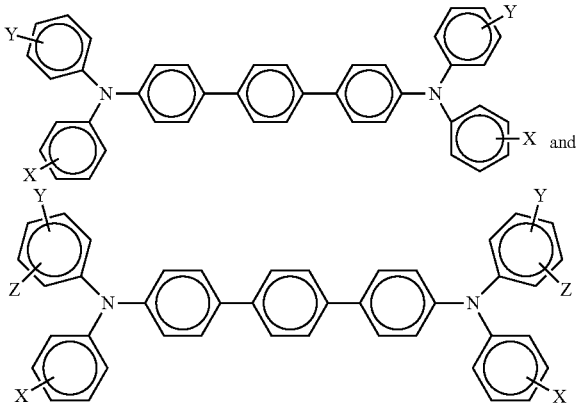

and wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl[p-terphenyl]4,4'-diamine, N,N'-bis(4-butylphenyl)-N,N'-di-m-tolyl-[p-terphenyl]-4,4'-diamine, N,N'-bis(4-butylphenyl)-N,N'-di-o-toly[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]4,4'-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene)carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules present, for example, in an amount of from about 50 to about 75 weight percent, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylpheny)[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine; hydrazones such as N-phenyl-N-methyl-3-(9-ethyl) carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency and transports them across the charge transport layer with short transit times includes N,N'-diphenyl-N,N'-bis(3-methylphenyl)-(1,1'-biphenyl)-4,4'-diamine, N,N'-bis (4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine, or mixtures thereof. If desired, the charge transport material in the charge transport layer may comprise a polymeric charge transport material or a combination of a small molecule charge transport material and a polymeric charge transport material.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate)methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Company, Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Company, Ltd.); hindered amine antioxidants such as SANOL™ LS-2626, LS-765, LS-770 and LS-744 (available from SNKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules, such as bis(4-diethylamino-2-methylphenyl)phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20, from about 1 to about 10, or from about 3 to about 8 weight percent.

Primarily for purposes of brevity, the examples of each of the substituents, and each of the components/compounds/molecules, polymers, (components) for each of the layers, specifically disclosed herein are not intended to be exhaustive. Thus, a number of components, polymers, formulas, structures, and R group or substituent examples, and carbon chain lengths not specifically disclosed or claimed are intended to be encompassed by the present disclosure and claims. Also, the carbon chain lengths are intended to include all numbers between those disclosed or claimed or envisioned, thus from 1 to about 20 carbon atoms, and from 6 to about 36 carbon atoms includes 1, 2, 3, 4, 5, 6, 7, 8, 9, 10, 11, 12, 13, 14, 15, up to 36, or more. At least one refers, for example, to from 1 to about 5, from 1 to about 2, 1, 2, and the like. Similarly, the thickness of each of the layers, the examples of components in each of the layers, the amount ranges of each of the components disclosed and claimed is not exhaustive, and it is intended that the present disclosure and claims encompass other suitable parameters not disclosed or that may be envisioned.

The following Examples are being submitted to illustrate embodiments of the present disclosure. These Examples are intended to be illustrative only, and are not intended to limit the scope of the present disclosure. Also, parts and percentages are by weight unless otherwise indicated. A Comparative Example and data are also provided.

Comparative Example 1

(A) A photoconductor was prepared by providing a 0.02 micrometer thick titanium layer coated (coater device used) on a biaxially oriented polyethylene naphthalate substrate (KALEDEX™ 2000) having a thickness of 3.5 mils, and applying thereon, with a gravure applicator or an extrusion coater, a solution containing 50 grams of 3-amino-propyltriethoxysilane, 41.2 grams of water, 15 grams of acetic acid, 684.8 grams of denatured alcohol, and 200 grams of heptane. This layer was then dried for about 5 minutes at 135° C. in the forced air dryer of the coater. The resulting blocking layer had a dry thickness of 500 Angstroms. An adhesive layer was then prepared by applying a wet coating over the blocking layer using a gravure applicator or an extrusion coater, and which adhesive layer contained 0.2 percent by weight based on the total weight of the solution of the copolyester adhesive (ARDEL™ D100 available from Toyota Hsutsu Inc.) in a 60:30:10 volume ratio mixture of tetrahydrofuran/monochlorobenzene/methylene chloride. The adhesive layer was then dried for about 5 minutes at 135° C. in the forced air dryer of the coater. The resulting adhesive layer had a dry thickness of 200 Angstroms.

A photogenerating layer dispersion was prepared by introducing 0.45 gram of the known polycarbonate IUPILON™ 200 (PCZ-200) or POLYCARBONATE Z™, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V), and 300 grams of ⅛ inch (3.2 millimeters) diameter stainless steel shot. The resulting mixture was then placed on a ball mill for 8 hours. Subsequently, 2.25 grams of PCZ-200 were dissolved in 46.1 grams of tetrahydrofuran, and added to the hydroxygallium phthalocyanine dispersion. The obtained slurry was then placed on a shaker for 10 minutes. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The photogenerating layer was dried at 120° C. for 1 minute in a forced air oven to form a dry photogenerating layer having a thickness of 0.4 micron.

The resulting imaging member web was then overcoated with two charge transport layers. Specifically, the photogenerating layer was overcoated with a charge transport layer (the bottom layer) in contact with the photogenerating layer. The bottom layer of the charge transport layer was prepared by introducing into an amber glass bottle in a weight ratio of 1:1 N,N'-diphenyl-N,N'-bis(3-methylphenyl)-1,1'-biphenyl-4,4'-diamine, and MAKROLON® 5705, a known polycarbonate resin having a molecular weight average of from about 50,000 to about 100,000, commercially available from Farbenfabriken Bayer A.G. The resulting mixture was then dissolved in methylene chloride to form a solution containing 15 percent by weight solids. This solution was applied on the photogenerating layer to form the bottom layer coating that upon drying (120° C. for 1 minute) had a thickness of 14.5 microns. During this coating process, the humidity was equal to or less than 15 percent.

The bottom layer of the charge transport layer was then overcoated with a top layer. The charge transport layer solution of the top layer was prepared by introducing into an amber glass bottle in a weight ratio of 0.35:0.65 N,N'-diphenyl-N,N'-bis(3-methylphenyl)-1,1'-biphenyl-4,4'-diamine, and MAKROLON® 5705, a known polycarbonate resin having a molecular weight average of from about 50,000 to about 100,000, commercially available from Farbenfabriken Bayer A.G. The resulting mixture was then dissolved in methylene chloride to form a solution containing 15 percent by weight solids. The top layer solution was applied on the bottom layer of the charge transport layer to form a coating that upon drying (1 20° C. for 1 minute) had a thickness of 14.5 microns. During this coating process, the humidity was equal to or less than 15 percent.

(B) A photoconductor was prepared by repeating the process of the above part (A), except that there was excluded the top charge transport layer, and the thickness of the bottom charge transport layer was 20 microns.

An overcoat layer solution, prepared as follows, was then applied to the top charge transport layer for each of the photoconductors of (A) and (B) resulting in a thickness of 3 microns for the final two photoconductor overcoats.

Preparation of Overcoat Layer Coating Solution:

An overcoat layer coating solution was formed by adding 10 grams of POLYCHEM® 7558-B-60 (an acrylated polyol obtained from OPC Polymers), 4 grams of PPG 2K (a polypropyleneglycol with a weight average molecular weight of 2,000 as obtained from Sigma-Aldrich), 6 grams of CYMEL® 1130 (a methylated, butylated melamine-formaldehyde crosslinking agent obtained from Cytec Industries Inc.), 8 grams of N,N'-diphenyl-N,N'-di[3-hydroxyphenyl]-terphenyl-diamine (DHTBD), 1.5 grams of SILCLEAN™ 3700 (a hydroxylated silicone available from BYK-Chemie USA), and 5.5 grams (1 percent by weight) of 8 percent p-toluenesulfonic acid catalyst in 60 grams of DOWANOL® PM (1-methoxy-2-propanol obtained from the Dow Chemical Company).

Example I

A photoconductive member was prepared by repeating the process of Comparative Example 1 (B) except that 0.1 weight percent of bis($\eta^5$-2,4-cyclopentadien-1-yl)bis[2,6-difluoro-3-(1H-pyrrol-1-yl)phenyl]titanium, obtained as IRGACURE® 784, from Ciba Specialty Chemicals, was dissolved in the above prepared overcoat layer solution, and then the resulting solution was applied as a coating to the charge transport layer at a coating thickness of 3 microns.

Example II

A photoconductive member was prepared by repeating the process of Comparative Example 1 (B) except that 0.5 weight percent of bis($\eta^5$-2,4-cyclopentadien-1-yl)bis[2,6-difluoro-3-(1H-pyrrol-1-yl)phenyl]titanium, obtained as IRGACURE® 784, from Ciba Specialty Chemicals, was dissolved in the above prepared overcoat layer solution, and then the resulting solution was applied as a top coating to the charge transport layer at a coating thickness of 3 microns.

Example III

A photoconductive member is prepared by repeating the process of Comparative Example 1 (A) except that 0.5 weight percent of bis($\eta^5$-2,4-cyclopentadien-1-yl)bis[2,6-difluoro-3-(1H-pyrrol-1-yl)phenyl]titanium, obtained as IRGACURE® 784, from Ciba Specialty Chemicals, is dissolved in the above prepared overcoat layer solution, and then the resulting solution is applied as a top coating to the top charge transport layer at a coating thickness of 3 microns.

Example IV

A number of photoconductors are prepared by repeating the process of Comparative Example 1 (B) except that there is included in the overcoat layer solution, 0.5 weight percent, at least one of titanocene bis(trifluoromethanesulfonate), titanocene dichloride, (indenyl)titanium (IV) trichloride, (pentamethylcyclopentadienyl)titanium (IV) trichloride, cyclopentadienyltitanium (IV) trichloride, bis(cyclopentadienyl)titanium (IV) pentasulfide, (4R,5R)-chloro-cyclopentadienyl-[2,2-dimethyl-1,3-dioxolan-4,5-bis(diphenylmethoxy)]titanium, and (4S,5S)-chloro-cyclopentadienyl-[2,2-dimethyl-1,3-dioxolan-4,5-bis(diphenylmethoxy)] titanium.

Example V

A number of photoconductors are prepared by repeating the process of Comparative Example 1 (A) except that there is included in the overcoat layer solution, 0.5 weight percent, at least one of titanocene bis(trifluoromethanesulfonate), titanocene dichloride, (indenyl)titanium (IV) trichloride, (pentamethylcyclopentadienyl)titanium (IV) trichloride, cyclopentadienyltitanium (IV) trichloride, bis(cyclopentadienyl)titanium (IV) pentasulfide, (4R,5R)-chloro-cyclopentadienyl-[2,2-dimethyl-1,3-dioxolan-4,5-bis(diphenylmethoxy)]titanium, and (4S,5S)-chloro-cyclopentadienyl-[2,2-dimethyl-1,3-dioxolan-4,5-bis(diphenylmethoxy)] titanium.

Electrical Property Testing

The above prepared photoreceptor devices (Comparative Example 1 (B) and Examples I and II) were tested in a scanner set to obtain photoinduced discharge cycles, sequenced at one charge-erase cycle, followed by one charge-expose-erase cycle, wherein the light intensity was incrementally increased with cycling to produce a series of photoinduced discharge characteristic curves from which the photosensitivity and surface potentials at various exposure intensities are measured. Additional electrical characteristics were obtained by a series of charge-erase cycles with incrementing surface potential to generate several voltage versus charge density curves. The scanner was equipped with a scorotron set to a constant voltage charging at various surface potentials. The devices were tested at surface potentials of 500 volts with the exposure light intensity incrementally increased by means of regulating a series of neutral density filters; the exposure light source was a 780 nanometer light emitting diode. The xerographic simulation was completed in an environmentally controlled light tight chamber at ambient conditions (40 percent relative humidity and 22° C.).

The photoconductors of Comparative Example 1 B) and Examples I and II exhibited substantially identical PIDCs. Thus, incorporation of the additive into the overcoat layer did not adversely affect the electrical properties of the Examples I and II photoconductors.

Light Shock Reduction

An in-house light shock test was performed for the above-prepared photoconductor devices (Comparative Examples 1 (B), and Example I). The top half of each of the above-prepared photoconductors was exposed under a fluorescent light (light energy about 324 μA) for about 37 minutes, and the PIDCs were measured immediately after light exposure. As comparison, the bottom half of the photoconductor was shielded by black paper during the above light exposure, and the PIDCs of the bottom halves were also measured. The light shock results are summarized in Table 1 below.

TABLE 1

| | LIGHT SHOCK PERCENT OF V (3.5 ergs/cm$^2$) |
|---|---|
| Comparative Example 1 (B) With Single-Layer Charge Transport Layer and Overcoat | 35 |
| Example I With Single-Layer Charge Transport Layer and Titanocene Overcoat | 19 |

V(3.5 ergs/cm$^2$), which is the surface potential of the photoconductor when the exposure is 3.5 ergs/cm$^2$, is used to characterize the photoconductor. When the photoconductor device is exposed to light, V(3.5 ergs/cm$^2$) is reduced immediately after exposure. For an ideal photoconductor, V(3.5 ergs/cm$^2$) should remain unchanged whether the photoconductor is exposed to light or not. A light shock percentage of V(3.5 ergs/cm$^2$) refers to $[V(3.5\ ergs/cm^2)_{unexposed}-V(3.5\ ergs/cm^2)_{exposed}]/V(3.5\ ergs/cm^2)_{unexposed}$. Thus, a light shock resistant photoconductor should have a small value of light shock percentage of V(3.5 ergs/cm$^2$), which indicates that the reduction in V(3.5 ergs/cm$^2$) after light exposure is minimal.

For the Comparative Example in Table 1, with no titanocene in the overcoat layer the light shock characteristics of the photoconductor were poor as compared to that of the photoconductor of Example I. Thus, incorporation of the titanocene additive into the overcoat layer rendered this photoconductor more light shock resistant.

Light shock, such as with the photoconductor of the Comparative Example 1 (B), causes dark bands to form on xerographic prints when the photoconductor is exposed to light at t=0. The light shock resistant Example I photoconductor does not xerographically print dark bands even when the photoconductor is exposed to light.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising:

a supporting member;

a photogenerating layer;

at least one charge transport layer wherein at least one of said charge transport layers is comprised of at least one charge transport component; and an overcoat layer comprised of a crosslinked polymeric network, a titanocene additive, and a charge transport component, and wherein said crosslinked polymeric network is comprised of an acrylated polyol, a polyalkylene glycol, and a crosslinking component, of an acrylated polyol, a polyalkylene glycol, and a crosslinking component, and wherein said titanocene additive is selected from the group consisting of at least one of bis($\eta^5$-2,4-cyclopentadien-1-yl)bis[2,6-difluoro-3-(1H-pyrrol-1-yl)phenyl]titanium, titanocene bis(trifluoromethanesulfonate, titanocene dichloride, (indenyl)titanium (IV) trichloride, (pentamethylcyclopentadienyl) titanium (IV) trichloride, cyclopentadienyltitanium (IV) trichloride, bis(cyclopentadienyl)titanium (IV) pentasulfide, (4R,5R)-chloro-cyclopentadienyl-[2,2-dimethyl-1,3-dioxolan-4,5-bis(diphenylmethoxy)]titanium, and (4S,5S)-chloro-cyclopentadienyl-[2,2-dimethyl-1,3-dioxolan-4,5-bis(diphenylmethoxy)] titanium.

2. A photoconductor in accordance with claim 1 wherein said overcoat layer further contains a catalyst and said crosslinked polymeric network is thermally cured.

3. A photoconductor in accordance with claim 1 wherein said crosslinking component is a melamine formaldehyde resin represented by

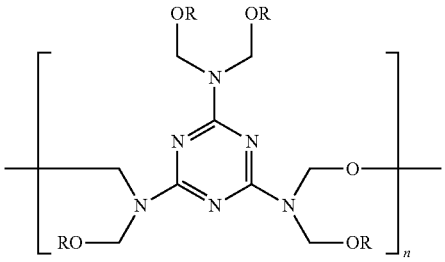

wherein R is selected from the group consisting of hydrogen, methyl, ethyl, propyl, butyl, and mixtures thereof; and n represents the number of repeating units of from about 1 to about 100; and said acrylated polyol is represented by $$[R_s—CH_2]_t—[—CH_2—R_a—CH_2]_p—[—CO—R_b—CO—]_n—[—CH_2—R_c—CH_2]_p—[—CO—R_d—CO—]_q$$

wherein $R_s$ represents $CH_2CR_1CO_2$—, wherein t equals 0 to about 1, and represents the mole fraction acrylic groups on available sites; wherein $[R_s—CH_2]_t$ can be located in linear or branched portions of $R_a$, $R_b$, $R_c$, and $R_d$; where $R_a$ and $R_c$ independently represent at least one of an alkyl group, and an alkoxy group; $R_b$ and $R_d$ independently represent at least one of an alkyl and alkoxy; and m, n, p, and q represent mole fractions, such that n+m+p+q is equal to about 1; and said polyalkylene glycol is polypropylene glycol.

4. A photoconductor in accordance with claim 1 wherein said crosslinking component is a melamine compound represented by

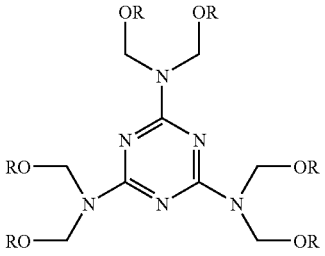

and R is selected from the group consisting of at least one of hydrogen, methyl, ethyl, propyl, and butyl; said acrylated polyol has a hydroxyl number of from about 500 to about 2,000; and said polyalkylene glycol possesses a weight average molecular weight of from about 100 to about 20,000, and wherein said acrylated polyol, said polyalkylene glycol, said crosslinking agent, and said overcoat charge transport component are reacted in the presence of said catalyst into a crosslinked overcoat layer.

5. A photoconductor in accordance with claim 1 wherein said overcoat charge transport component is selected from the group consisting of at least one of (i) a phenolic substituted aromatic amine, and (ii) a primary alcohol substituted aromatic amine, and wherein at least one charge transport layer is 1, 2, 3, or 4 layers.

6. A photoconductor in accordance with claim 1 wherein said overcoat charge transport component is

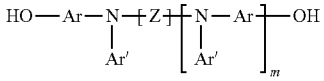

wherein m is zero or 1; Z is selected from the group consisting of at least one of

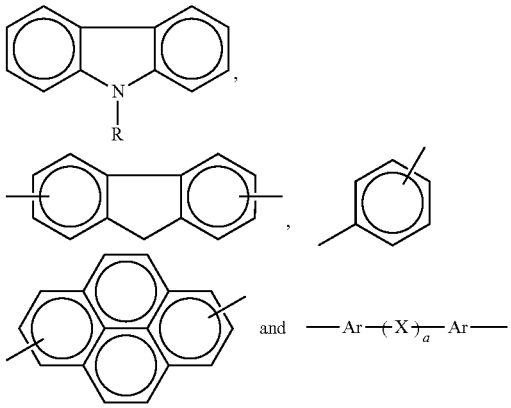

wherein n is 0 or 1; Ar is selected from the group consisting of at least one of

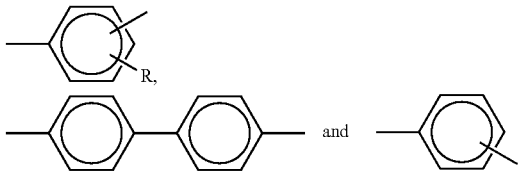

R is selected from the group consisting of at least one of —$CH_3$, —$C_2H_5$, —$C_3H_7$, and $C_4H_9$, and Ar' is selected from the group consisting of at least one of

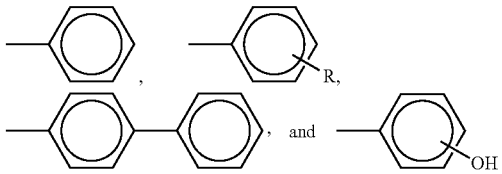

and X is selected from the group consisting of at least one of

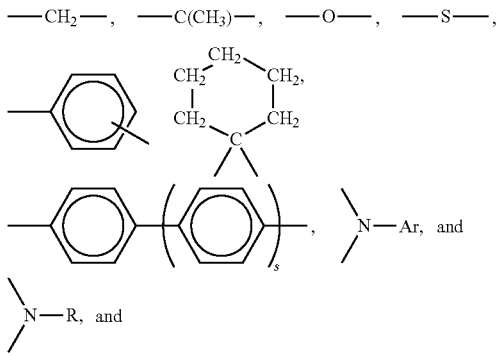

wherein S is zero, 1, or 2.

7. A photoconductor in accordance with claim 1 wherein said overcoat charge transport component is N,N'-diphenyl-N,N'-bis(3-hydroxyphenyl)-[1,1'-biphenyl]-4,4'-diamine (DHTPD).

8. A photoconductor in accordance with claim 1 wherein said overcoat charge transport component is a terphenyl diamine as represented by

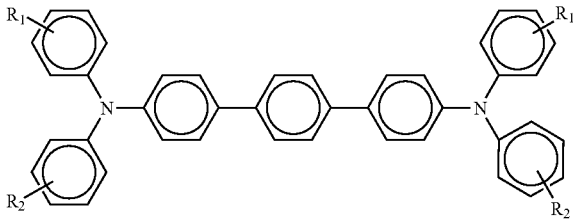

wherein $R_1$ and $R_2$ are independently selected from the group consisting of hydrogen, hydroxyl, alkyl having from 1 to about 12 carbon atoms, arylalkyl having from about 7 to about 36 carbon atoms, and aryl having from about 6 to about 36 carbon atoms groups; and wherein at least one of $R_1$ and $R_2$ is other than hydrogen.

9. A photoconductor in accordance with claim 1 wherein said titanocene additive is titanocene bis(trifluoromethanesulfonate), titanocene dichloride, (indenyl)titanium (IV) trichloride, (pentamethylcyclopentadienyl)titanium (IV) trichloride, or cyclopentadienyltitanium (IV) trichloride.

10. A photoconductor in accordance with claim 1 wherein said titanocene is bis($\eta^5$-2,4-cyclopentadien-1-yl)bis[2,6-difluoro-3-(1H-pyrrol-1-yl)phenyl]titanium.

11. A photoconductor in accordance with claim 1 wherein said titanocene is present in an amount of from about 0.05 to about 20 weight percent.

12. A photoconductor in accordance with claim 1 wherein said titanocene is present in an amount of from about 1 weight percent to about 7 weight percent.

13. A photoconductor in accordance with claim 1 wherein said overcoat layer further comprises a crosslinkable fluoro additive or a siloxane component.

14. A photoconductor in accordance with claim 13 wherein said crosslinkable additive is present in an amount of from about 0.01 to about 5 weight percent.

15. A photoconductor in accordance with claim 2 wherein said catalyst is an acid present in an amount of from about 0.01 to about 4 weight percent.

16. A photoconductor in accordance with claim 1 wherein said charge transport component is comprised of aryl amine molecules, and which aryl amines are represented by

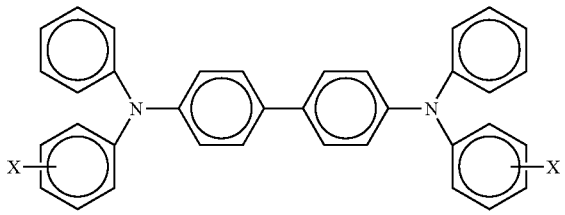

wherein X is selected from the group consisting of alkyl, alkoxy, aryl, and halogen, and mixtures thereof and said at least one is from 1 to about 4.

17. A photoconductor in accordance with claim 1 wherein said charge transport component is comprised of aryl amine molecules, and which aryl amines are represented by

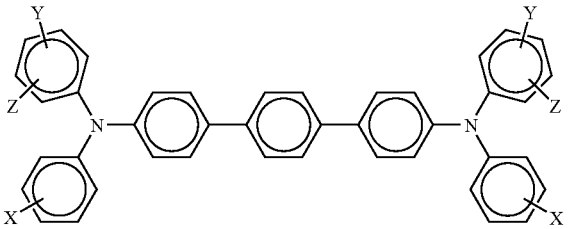

wherein X, Y, and Z are independently selected from the group consisting of alkyl, alkoxy, aryl, and halogen, and mixtures thereof.

18. A photoconductor in accordance with claim 1 wherein said charge transport component in said overcoat layer, or in said at least one charge transport layer is an aryl amine selected from at least one of the group consisting of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine.

19. A photoconductor in accordance with claim 1 further including in at least one of said charge transport layers an antioxidant comprised of a hindered phenolic, a hindered amine, and mixtures thereof.

20. A photoconductor in accordance with claim 1 wherein said photogenerating layer is comprised of a photogenerating pigment or photogenerating pigments.

21. A photoconductor in accordance with claim 20 wherein said photogenerating pigment is comprised of at least one of a titanyl phthalocyanine, a hydroxygallium phthalocyanine, a halogallium phthalocyanine, a perylene, or mixtures thereof.

22. A photoconductor in accordance with claim 20 wherein said photogenerating pigment is comprised of a metal phthalocyanine, a metal free phthalocyanine, a perylene, or mixtures thereof.

23. A photoconductor in accordance with claim 1 further including a hole blocking layer, and an adhesive layer, and wherein said at least one charge transport layer is comprised of a top charge transport layer and a bottom charge transport layer, and wherein said top layer is in contact with said bottom layer and said bottom layer is in contact with said photogenerating layer, and said overcoat layer is in contact with said top charge transport layer.

24. A photoconductor consisting essentially of and in sequence a supporting substrate, a photogenerating layer, a charge transport layer, and thereover an overcoat layer comprised of an acrylated polyol, a polyalkylene glycol, a crosslinking component, a titanocene, additive present in an amount of from about 0.05 to about 20 weight percent, and a charge transport compound, and wherein said titanocene is at least one of bis($\eta^5$-2,4-cyclopentadien-1-yl)bis[2,6-difluoro-3-(1H-pyrrol-1-yl)phenyl]titanium, titanocene bis(trifluoromethanesulfonate), titanocene dichloride, (indenyl)titanium (IV) trichloride, (pentamethylcyclopentadienyl) titanium (IV) trichloride, cyclopentadienyltitanium (IV) trichloride, bis(cyclopentadienyl)titanium (IV) pentasulfide, (4R,5R)-chloro-cyclopentadienyl-[2,2-dimethyl-1,3-dioxolan-4,5-bis(diphenylmethoxy)]titanium, and (4S,5S)-chloro-cyclopentadienyl-[2,2-dimethyl-1,3-dioxolan-4,5-bis (diphenylmethoxy)]titanium represented by the following formulas/structures

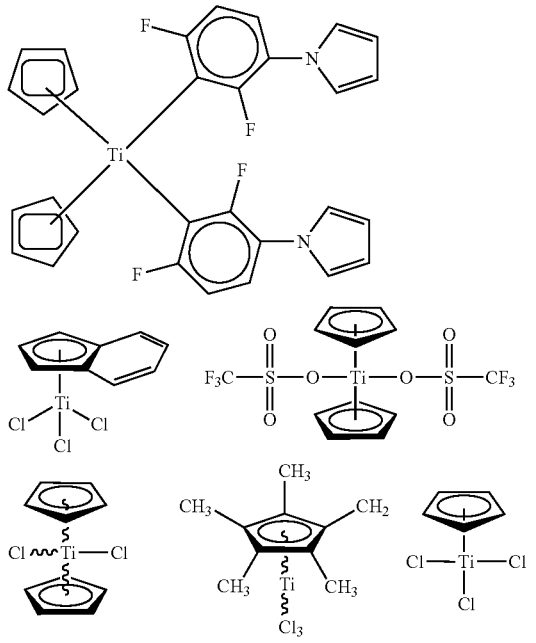

-continued

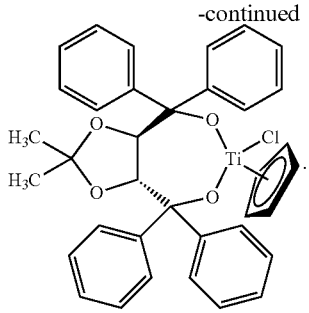

25. A photoconductor comprising:

a photogenerating layer comprised of at least one photogenerating pigment and an optional resin binder;

hole transport layers comprised of a top hole transport layer comprised of a hole transport compound and a resin binder, and a bottom hole transport layer comprised of a hole transport compound and a resin binder, said bottom hole transport layer being in contact with said photogenerating layer, and in contact with and contiguous to said top charge transport layer a protective layer comprised of a titanocene, a crosslinked polymer, and a hole transport compound, said top and said bottom hole transport layer containing from about 10 to about 75 weight percent of a hole transport compound selected from at least one of the group consisting of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4butylphenyl)-N,N'-di-o-tolyl-[p-terphenyl]-4,4'-diamine, N,N'bis(4-butylphenyl)-N,N'-bis(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine; and said titanocene present in an amount of from about 0.1 to about 0.5 weight percent is at least one of bis($\eta^5$-2,4-cyclopentadien-1-yl)bis[2,6-difluoro-3-(1H-pyrrol-1-yl)phenyl]titanium, titanocene bis(trifluoromethanesulfonate), titanocene dichloride, (indenyl)titanium (IV) trichloride, (pentamethylcyclopentadienyl)titanium (IV) trichloride, cyclopentadienyltitanium (IV) trichloride, bis(cyclopentadienyl)titanium (IV) pentasulfide, (4R,5R)-chloro-cyclopentadienyl-[2,2-dimethyl-1,3-dioxolan-4,5-bis(diphenylmethoxy)]titanium, and (4S,5S)-chloro-cyclopentadienyl-[2,2-dimethyl-1,3dioxolan-4,5-bis(diphenylmethoxy)]titanium.

26. A photoconductor in accordance with claim 25 wherein said titanocene, is bis($\eta^5$-2,4-cyclopentadien -1-yl)bis[2,6-difluoro-3-(1H-pyrrol-1-yl)phenyl]titanium.

* * * * *